US005266014A

United States Patent [19]

Yokota

[11] Patent Number: 5,266,014

[45] Date of Patent: Nov. 30, 1993

[54] PRESTROKE ADJUSTMENT MECHANISM FOR FUEL INJECTION PUMP

[75] Inventor: Tohru Yokota, Higashi-Matsuyama, Japan

[73] Assignee: Zexel Corporation, Japan

[21] Appl. No.: 88,115

[22] Filed: Jul. 9, 1993

Related U.S. Application Data

[63] Continuation of Ser. No. 846,006, Mar. 4, 1992, abandoned.

[30] Foreign Application Priority Data

Mar. 11, 1991 [JP] Japan ..... 3-20959[U]

[51] Int. Cl.[5] ..... F04B 7/04

[52] U.S. Cl. ..... 417/499; 417/494; 123/503; 123/504

[58] Field of Search ..... 417/499, 494; 123/495, 123/503, 500

[56] References Cited

U.S. PATENT DOCUMENTS

| | | | |
|---|---|---|---|
| 4,567,868 | 2/1986 | Yasuhara | 123/503 |
| 4,635,602 | 1/1987 | Eheim | 123/500 |
| 4,721,442 | 1/1988 | Tanaka | 123/500 |
| 4,737,086 | 4/1988 | Yamaguchi | 123/500 |
| 4,754,737 | 7/1988 | Ishida | 123/500 |
| 5,080,564 | 1/1992 | Kasahara | 417/494 |

FOREIGN PATENT DOCUMENTS

| | | | |
|---|---|---|---|
| 2-129314 | 1/1992 | Japan | 123/495 |

*Primary Examiner*—Richard A. Bertsch
*Assistant Examiner*—Peter Korytnyk
*Attorney, Agent, or Firm*—Ostrolenk, Faber, Gerb & Soffen

[57] ABSTRACT

A prestroke adjustment mechanism for a fuel injection pump comprises a U-shaped lever provided on the outer surface of the pump housing for rotating a timing control rod of the injection pump and a rotation limit pin provided on the same outer surface for limiting the rotation of the U-shaped lever. The timing control rod is linked with a control sleeve on the pump plunger for adjusting the prestroke. By limiting the rotation of the U-shaped lever, the rotation limiting pin limits the height of the control sleeve for ensuring establishment between the top of the control sleeve and the bottom of the upper section of the plunger barrel of a gap for dissipating the force of the spill jet during fuel spill. As a result, the downward force of internal turbulence produced by the spill jet is dissipated, thereby preventing the control sleeve from slipping downward and ensuring stable and reliable prestroke adjustment.

4 Claims, 3 Drawing Sheets

PRESTROKE ADJUSTMENT MECHANISM FOR FUEL INJECTION PUMP

This is a continuation of application Ser. No. 07/846,006, filed Mar. 4, 1992, now abandoned.

BACKGROUND OF THE INVENTION

1. Field of the Invention

This invention relates to a prestroke adjustment mechanism for a fuel injection pump and more particularly to a prestroke adjustment mechanism for a fuel injection pump capable of reducing the force of internal turbulence owing to spill jetting of fuel.

2. Prior Art Statement

Conventional fuel injection pumps are equipped with a prestroke adjustment mechanism for varying the prestroke. The mechanism generally achieves the adjustment by varying the relative position between a vertically reciprocating plunger and a control sleeve.

Prestroke adjustment mechanisms of this type are taught, for example, by Japanese Utility Model Public Disclosure Nos. Sho 58-114875 and Sho 53-9460.

A typical structural arrangement of the prestroke adjustment mechanism of a fuel injection pump will be explained with reference to FIGS. 3 to 6.

FIGS. 3 to 5 are sectional views of the essential part of a fuel injection pump 1. FIG. 3 shows the pump at the beginning of fuel injection, FIG. 4 shows it at the end of fuel injection, and FIG. 5 shows it at the time of fuel spill.

The fuel injection pump 1 has a pump housing 2, a plunger barrel 3, a plunger 4, a control sleeve 5 and a timing control rod 6.

The pump housing 2 is formed with a fuel inlet 7 and a fuel reservoir 8 extending from the pump housing 2 into the plunger barrel 3, and the plunger barrel 3 is formed with a fuel compression chamber 9. The plunger 4 is reciprocated vertically by rotational driving force from an engine (not shown). As a result, fuel passes from the fuel inlet 7 through the fuel reservoir 8 to the fuel compression chamber 9 where it is pressurized and delivered to an injection nozzle (not shown) through an injection tube 10.

More specifically, the plunger 4 has a fuel suction and discharge hole 11 which constitutes a fuel suction port opening into the fuel reservoir 8, a center communication hole 12 formed axially at its center so as to communicate the fuel suction and discharge hole 11 with the fuel compression chamber 9, an inclined control lead 13 formed on its outer surface, and a vertical groove 14 for communicating the inclined control lead 13 with the orifice of the fuel suction and discharge hole 11.

The control sleeve 5 is fitted on the plunger to be slidable thereon. It is formed with a cutoff hole 15 which passes radially therethrough. The cutoff hole 15 is disposed so to be able to communicate with the inclined control lead 13 in the course of the vertical motion of the plunger 4.

The control sleeve 5 and the timing control rod 6 are linked by an eccentric pin 16. The timing control rod 6 is connected with a rotary solenoid or other such actuator (not shown) and the vertical position of the control sleeve 5 relative to the plunger 4 can be adjusted by rotating the actuator.

The operation of the fuel injection pump 1 of the aforesaid structure will now be explained.

When the plunger 4 first starts to rise from its bottom dead point, the fuel suction and discharge hole 11 is open to the fuel reservoir 8 and, therefore, the fuel reservoir 8 and the fuel compression chamber 9 are in communication via the fuel suction and discharge hole 11 and the center communication hole 12. Because of this, the fuel pressure in the fuel compression chamber 9 does not rise and there is no delivery of pressurized fuel.

As shown in FIG. 3, actual delivery of pressurized fuel starts when the plunger has risen to the point where the fuel suction and discharge hole 11 is closed by the control sleeve 5 so that the fuel pressure in the fuel compression chamber 9 can increase.

The stroke of the plunger 4 between the bottom dead point and the point at which pressurized fuel delivery starts is called the prestroke.

When the plunger 4 rises to the point shown in FIG. 4, the inclined control lead 13 comes into communication with the cutoff hole 15 of the control sleeve 5. As a result, the cutoff hole 15 and the fuel compression chamber 9 are communicated via the inclined control lead 13, vertical groove 14, fuel suction and discharge hole 11 and center communication hole 12 so that the fuel in the fuel compression chamber 9 escapes to the fuel reservoir 8. This is called fuel spill. The pressure of the fuel in the fuel compression chamber 9 therefore decreases and the delivery of pressurized fuel ends.

As can be seen in FIG. 5, the plunger 4 continues to rise even after the completion of pressurized fuel supply so that the inclined control lead 13 rises beyond the cutoff hole 15 to be closed by the control sleeve 5 and the upper part of the inclined control lead 13 projects above the control sleeve 5 into the fuel reservoir 8. As a result, fuel spills from upper part of the inclined control lead 13 into the fuel reservoir 8.

Then when the plunger 4 descends, fuel is sucked from the fuel reservoir 8 into the fuel compression chamber 9 owing to the negative pressure in the fuel compression chamber 9.

As indicated by the arrows in FIG. 3, the timing control rod 6 can be rotated in either direction to raise and lower the control sleeve 5 for varying its position relative to the plunger 4. It is thus possible to adjust the prestroke, i.e., to control the fuel injection timing.

As shown in FIG. 6, however, when the engine is stopped, the force of a spring (not shown) provided in the aforesaid actuator positions the control sleeve 5 to the uppermost position in the fuel reservoir 8, namely the position at which the top 5A of the control sleeve 5 abuts on the bottom 3A of the upper section of the plunger barrel 3. The prestroke is adjusted with the control sleeve in this position for matching the characteristics of the fuel adjustment pump to the requirements of the engine in which it is used.

When a long prestroke is employed with this type of prestroke adjustment mechanism, the gap between the top 5A of the control sleeve 5 and the bottom 3A of the upper section of the plunger barrel 3 becomes narrow. Since the sectional area of the spill jet escape passage therefore becomes small, the pressure of the spill jet becomes large and the high pressure thereof exerts a downward force (force of internal turbulence) on the control sleeve 5. As a result, it becomes impossible to control the prestroke.

The invention was completed in the light of the foregoing problems and has as its object to provide a prestroke adjustment mechanism for a fuel injection pump which enables prestroke adjustment to be achieved in such manner that an adequate gap is established between the top of the control sleeve and the bottom of the upper section of the plunger barrel, thereby preventing adverse effect from the force of internal turbulence and ensuring stable and reliable prestroke control.

SUMMARY OF THE INVENTION

For achieving this object, the present invention provides a prestroke adjustment mechanism for a fuel injection pump which is able to limit the rotational range of the timing control rod and more specifically provides a prestroke adjustment mechanism for a fuel injection pump including a pump housing defining a fuel reservoir, a plunger barrel disposed inside the pump housing and defining a fuel compression chamber, a plunger for reciprocating inside the plunger barrel, the reciprocating motion of the plunger causing fuel to be drawn from the fuel reservoir and delivered out of the fuel injection pump in a pressurized state, a control sleeve slidably fitted on the plunger and a timing control rod linked with the control sleeve, wherein the prestroke adjustment mechanism adjusts the prestroke of the fuel injection pump by rotating the timing control rod for varying the position of the control sleeve relative to the axial direction of the plunger, the prestroke adjustment mechanism comprising a U-shaped lever provided on an outer surface of the pump housing for rotating the timing control rod and a rotation limit pin provided on the same outer surface of the pump housing within the rotational range of the U-shaped lever, the rotation of the U-shaped lever being limited by abutment with the rotation limit pin.

Since the prestroke adjustment mechanism is provided with the rotation limit pin within the rotational range of the U-shaped lever, the establishment of a gap of a prescribed magnitude between the top of the control sleeve and the bottom of the upper section of the plunger barrel is ensured even when the control sleeve comes to be positioned at the uppermost part of the fuel reservoir as a result of prestroke setting. As a result, the force of the spill jet during fuel spill can be dissipated, whereby the downward force of internal turbulence caused by the spill jet can be dissipated, making it possible to achieve stable and reliable prestroke control.

DETAILED DESCRIPTION OF THE PREFERRED EMBODIMENT

Figure 1:
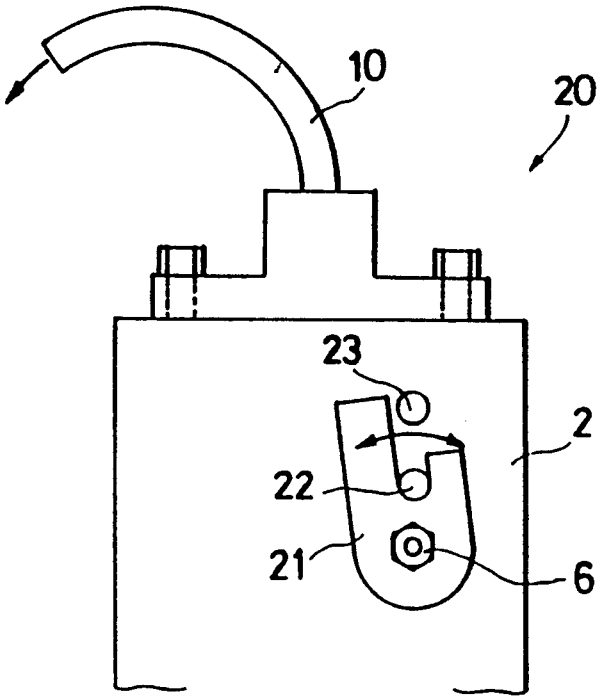
FIG. 1 is a side view of a fuel injection pump equipped with a prestroke adjustment mechanism which is an embodiment of the invention.

An embodiment of the prestroke adjustment mechanism according to the invention will now be described with reference to FIGS. 1 and 2. The members corresponding to those in FIGS. 3 to 6 are assigned identical reference numerals and will not be described further here.

FIG. 1 is a side view of a fuel injection pump 20 equipped with a prestroke adjustment mechanism according to the invention. One end of the timing control rod 6 is exposed at the outer surface of the pump housing 2 and a U-shaped lever 21 is fixed on the exposed end of the timing control rod 6.

The U-shaped lever 21 is engaged with a drive shaft 22 of the aforesaid actuator. By operating the actuator for rotating the drive shaft 22 it is therefore possible to turn the U-shaped lever 21 for rotating the timing control rod 6 by a prescribed angle.

This rotation of the timing control rod 6 causes the control sleeve 5 to move up or down in the manner explained earlier. It is thus possible to adjust the relative position of the control sleeve 5 with respect to the plunger 4.

A rotation limit pin 23 is provided to project from the surface of the pump housing 2. The rotation limit pin 23 is positioned within the rotational range of the U-shaped lever 21 and the rotation of the U-shaped lever 21 is limited by abutment therewith.

Figure 2:
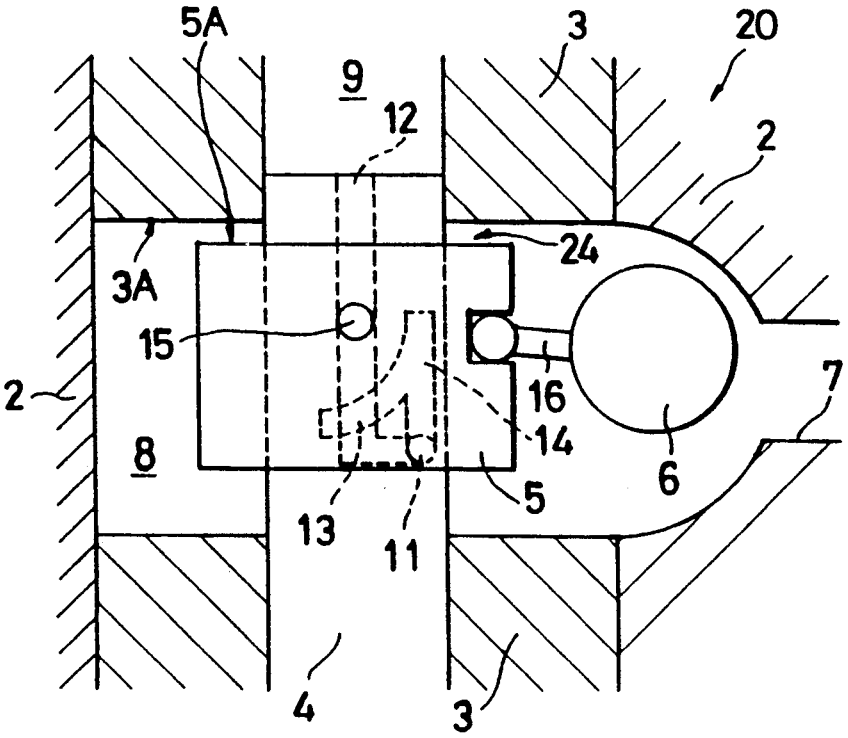
FIG. 2 is a sectional view of the essential part of the fuel injection pump of FIG. 1 showing the state when a U-shaped lever of the prestroke adjustment mechanism abuts on a rotation limit pin thereof.
Figure 3:
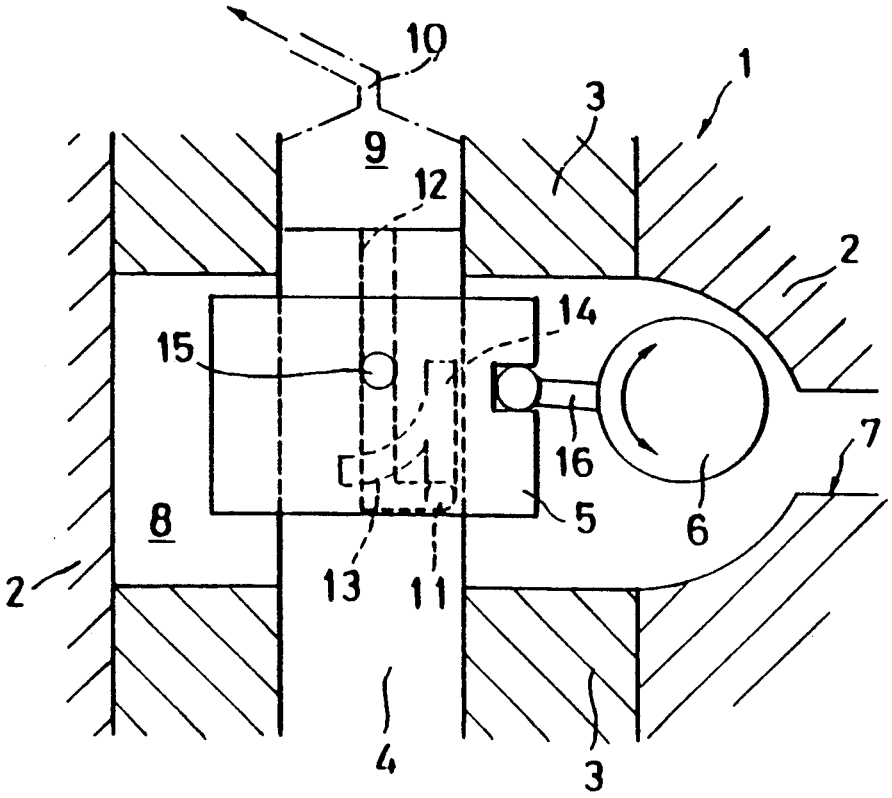
FIG. 3 PRIOR ART
FIG. 3 is a sectional view of the essential part of a conventional injection pump showing the state at the beginning of fuel injection.
Figure 4:
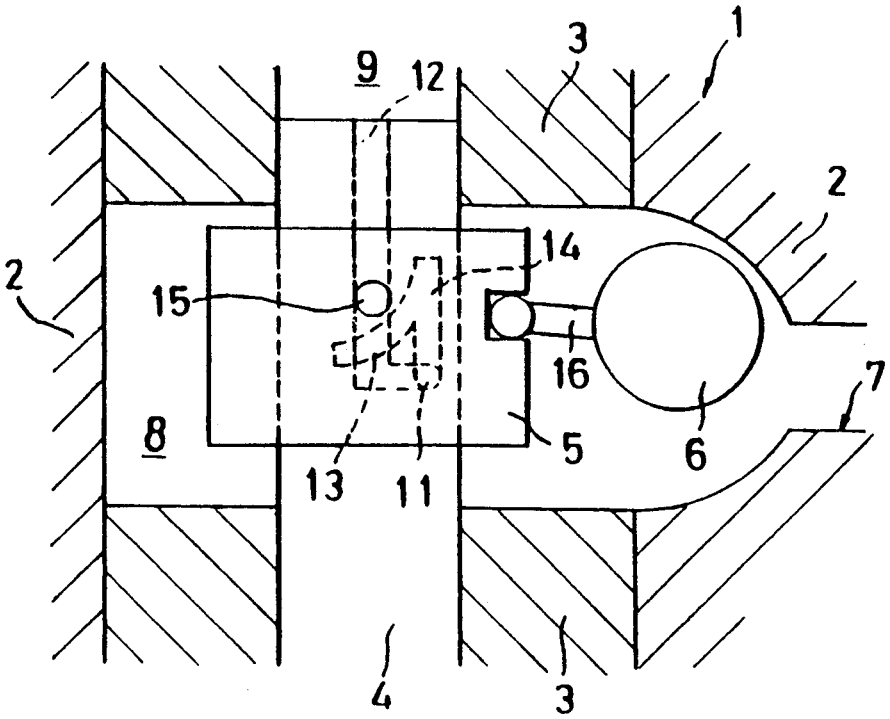
FIG. 4 PRIOR ART
FIG. 4 is a sectional view similar to that of FIG. 3 showing the state at the end of fuel injection.
Figure 5:
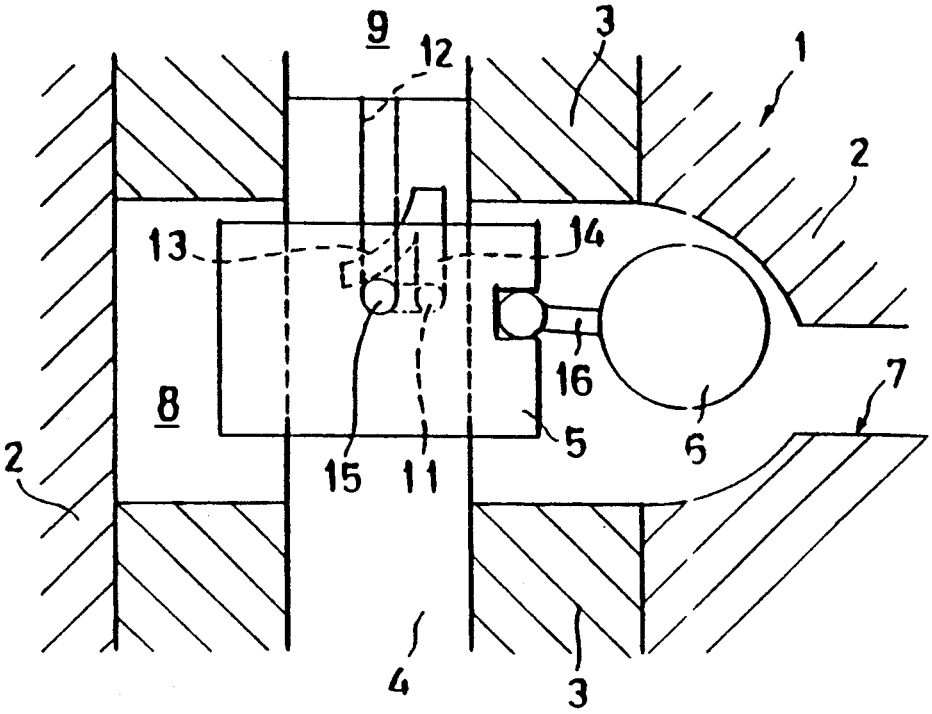
FIG. 5 PRIOR ART
FIG. 5 is a sectional view similar to that of FIG. 3 showing the state at the time of fuel spill.
Figure 6:
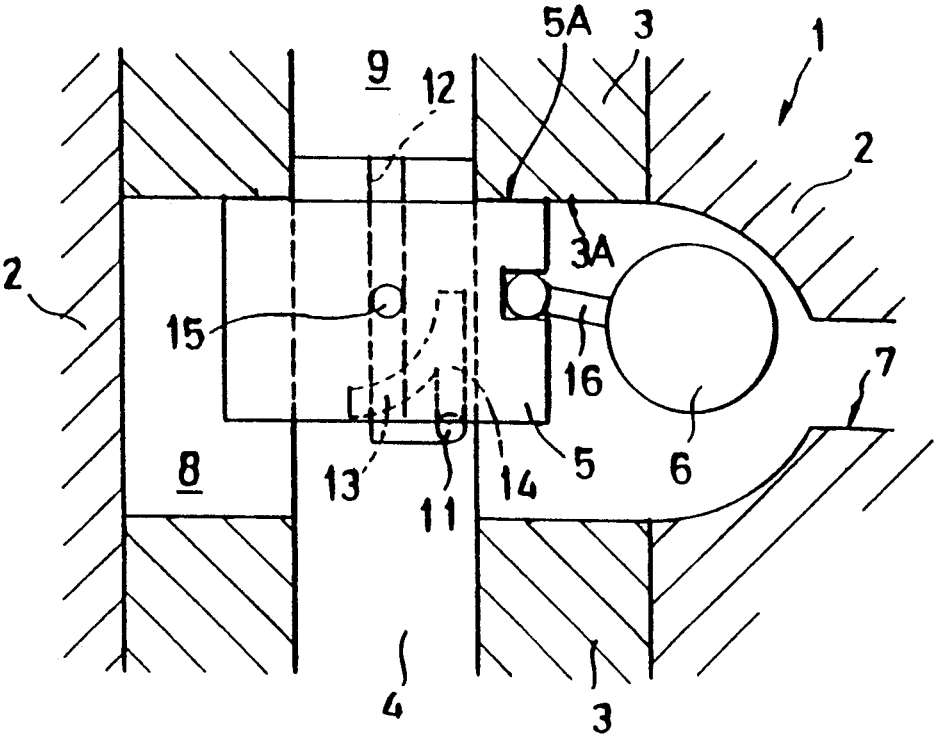
FIG. 6 PRIOR ART
FIG. 6 is a sectional view similar to that of FIG. 3 showing the state when the top of a control sleeve abuts on the bottom of the upper section of a plunger barrel.

The abutment of the U-shaped lever 21 on the rotation limit pin 23 prevents the control sleeve 5 from rising beyond a prescribed height, such as that shown in FIG. 2. A gap 24 of prescribed size is thus established at this time between the control sleeve 5 and the plunger barrel 3.

The prestroke adjustment is thus conducted in the state illustrated in FIG. 2. More specifically, since the rotational range of the U-shaped lever 21 is restricted by the rotation limit pin 23, the gap 24 is not narrowed beyond that illustrated during operation of the fuel injection pump 20. Since the downward force of the spill jet is therefore dissipated, the control sleeve 5 is unaffected by the spill jet and prestroke control can be conducted stably and reliably.

It will of course be understood that the magnitude of the gap 24 can be adjusted by selecting the position at which the rotation limit pin 23 is provided.

In accordance with this invention, since the abutment serving as the basis for the prestroke adjustment is that between the U-shaped lever attached to the timing control rod and the rotation limit pin provided on the surface of the pump housing, a gap can invariably be established between the top of the control sleeve and the bottom of the upper section of the plunger barrel. Since it is therefore possible to avoid adverse effect of the force of internal turbulence during fuel spill, it becomes possible to realize stable and reliable prestroke control.

What is claimed is:

1. A prestroke adjustment mechanism for a fuel injection pump, the injection pump comprising:

a pump housing defining a fuel reservoir, a plunger barrel disposed inside the pump housing and defining a fuel compression chamber, a plunger disposed inside the plunger barrel and movable in a reciprocating motion for drawing fuel from the fuel reservoir and delivering the fuel out of the fuel injection pump in a pressurized state, a control sleeve slidably fitted on the plunger, the control sleeve including a cutoff aperture, and a timing control rod linked to the control sleeve, the plunger having a fuel suction and discharge aperture, a center communication aperture, an inclined control lead and a vertical groove, whereby descent of the plunger causes fuel to be drawn from the fuel reservoir through the fuel suction and discharge aperture and into the fuel compression chamber, ascent of the plunger causes the fuel suction and discharge aperture to be closed by the control sleeve to start the delivery of pressurized fuel, further ascent of the plunger causes the cutoff aperture to communicate with the inclined control lead and end the delivery of pressurized fuel by allowing fuel to spill through the cutoff aperture, and still further ascent of the plunger causes the vertical groove to project above an upper edge of the control sleeve for allowing fuel to spill from the vertical groove through a gap of predetermined size defined by an upper edge of the control sleeve and a lower edge of an upper section of the plunger barrel for spilling fuel from the vertical groove to the fuel reservoir, wherein the prestroke adjustment mechanism adjusts the prestroke of the fuel injection pump, with the gap established, by rotating the timing control rod to vary the position of the control sleeve relative to the axial direction of the plunger, the prestroke adjustment mechanism comprising:

a rotatable lever located on an outer surface of the pump housing for rotating the timing control rod; and a rotation limit pin located on the outer surface of the pump housing for rotating the timing control rod; and a rotation limit pin located on the outer surface of the pump housing at a location within the rotational range of the lever, whereby rotation of the lever is limited by abutment with the rotation limit pin, and movement of the control sleeve is limited in the upward direction of increasing prestroke by abutment of the lever with the rotation limit pin, to maintain the gap of predetermined size between the control sleeve and the plunger barrel after completion of delivery of the pressurized fuel.

2. A prestroke adjustment mechanism for a fuel injection pump according to claim 1 wherein the prestroke is adjusted by rotating the timing control rod to raise and lower the control sleeve in the axial direction of the plunger within the fuel reservoir.

3. A prestroke adjustment mechanism for a fuel injection pump according to claim 1 wherein the lever is U-shaped.

4. A prestroke adjustment mechanism for a fuel injection pump according to claim 3 further comprising a drive shaft for rotating the U-shaped lever.

* * * * *

UNITED STATES PATENT AND TRADEMARK OFFICE

CERTIFICATE OF CORRECTION

PATENT NO. : 5,266,014

DATED : November 30, 1993

INVENTOR(S) : Tohru Yokota

It is certified that error appears in the above-indentified patent and that said Letters Patent is hereby corrected as shown below:

IN THE CLAIMS:

Claim 1, column 6, lines 4-6, delete entirely.

Signed and Sealed this

Twenty-fourth Day of May, 1994

Bruce Lehman

*Attest:*

BRUCE LEHMAN

*Attesting Officer*

*Commissioner of Patents and Trademarks*